US006823941B2

(12) United States Patent
Donald

(10) Patent No.: US 6,823,941 B2
(45) Date of Patent: Nov. 30, 2004

(54) RECOVERY OF PRODUCTION FLUIDS FROM AN OIL OR GAS WELL

(76) Inventor: Ian Donald, Ramstone Millhouse Moneymusk, Aberdeenshire AB51 7TS (GB)

( * ) Notice: Subject to any disclaimer, the term of this patent is extended or adjusted under 35 U.S.C. 154(b) by 0 days.

(21) Appl. No.: 10/415,156

(22) PCT Filed: Nov. 7, 2001

(86) PCT No.: PCT/GB01/04940

§ 371 (c)(1),
(2), (4) Date: Apr. 25, 2003

(87) PCT Pub. No.: WO02/38912

PCT Pub. Date: May 16, 2002

(65) Prior Publication Data

US 2004/0026084 A1 Feb. 12, 2004

(30) Foreign Application Priority Data

Nov. 8, 2000 (GB) ..... 0027269

(51) Int. Cl.[7] ..... E21B 29/12; E21B 19/00

(52) U.S. Cl. ..... 166/368; 166/88.1; 166/75.13; 166/86.2

(58) Field of Search ..... 166/368, 86.1, 166/86.2, 88.1, 88, 75.13, 97, 97.1, 89.1

(56) References Cited

U.S. PATENT DOCUMENTS

| | | | | | |
|---|---|---|---|---|---|
| 1,944,840 | A | * | 1/1934 | Humason | 166/87.1 |
| 3,101,118 | A | | 8/1963 | Culver et al. | |
| 4,260,022 | A | | 4/1981 | Van Bilderbeek | |
| 4,405,016 | A | | 9/1983 | Best | |
| 4,502,534 | A | * | 3/1985 | Roche et al. | 166/84.4 |
| 4,607,701 | A | | 8/1986 | Gundersen | |
| 4,874,008 | A | | 10/1989 | Lawson | |
| 5,010,956 | A | | 4/1991 | Bednar | |
| 5,143,158 | A | | 9/1992 | Watkins et al. | |
| 5,535,826 | A | * | 7/1996 | Brown et al. | 166/363 |
| 5,544,707 | A | * | 8/1996 | Hopper et al. | 166/382 |
| 5,868,204 | A | | 2/1999 | Pritchett et al. | |
| 6,050,339 | A | | 4/2000 | Milberger | |
| 6,109,352 | A | * | 8/2000 | Edwards et al. | 166/336 |
| 6,138,774 | A | * | 10/2000 | Bourgoyne et al. | 175/7 |
| 6,145,596 | A | | 11/2000 | Dallas | |
| 6,227,300 | B1 | * | 5/2001 | Cunningham et al. | 166/339 |
| 6,557,629 | B2 | * | 5/2003 | Wong et al. | 166/76.1 |
| 6,612,368 | B2 | * | 9/2003 | Kent et al. | 166/75.13 |
| 6,637,514 | B1 | * | 10/2003 | Donald et al. | 166/368 |

FOREIGN PATENT DOCUMENTS

| | | | |
|---|---|---|---|
| EP | 0572732 | A | 12/1993 |
| EP | 0841464 | A2 | 5/1998 |
| GB | 2197675 | A | 5/1988 |
| GB | 2319795 | A | 6/1998 |
| GB | 2346630 | A | 8/2000 |
| GB | 2361726 | A | 10/2001 |
| WO | WO99/28593 | A | 6/1999 |
| WO | WO00/70185 | A | 11/2000 |

* cited by examiner

*Primary Examiner*—Thomas B. Will
*Assistant Examiner*—Thomas A Beach
(74) *Attorney, Agent, or Firm*—Drinker Biddle & Reath LLP

(57) ABSTRACT

A flow diverter assembly for a tree, the flow diverter assembly having a flow diverter to divert fluids flowing through the production bore of the tree from a first portion of the production bore to the cap, and to divert the fluids back from the cap to a second portion of the production bore for recovery therefrom via an outlet, wherein the flow diverter is detachable from the cap to enable insertion of the flow diverter through the cap.

21 Claims, 8 Drawing Sheets

RECOVERY OF PRODUCTION FLUIDS FROM AN OIL OR GAS WELL

The present invention relates to the recovery of production fluids from an oil or gas well having a Christmas tree.

Christmas trees are well known in the art of oil and gas wells, and generally comprise an assembly of pipes, valves and fittings installed in a wellhead after completion of drilling and installation of the production tubing to control the flow of oil and gas from the well. Subsea Christmas trees typically have at least two bores one of which communicates with the production tubing (the production bore), and the other of which communicates with the annulus (the annulus bore). The annulus bore and production bore are typically side by side, but various different designs of Christmas tree have different configurations (i.e. concentric bores, side by side bores, and more than two bores etc).

Typical designs of Christmas tree have a side outlet to the production bore closed by a production wing valve for removal of production fluids from the production bore. The top of the production bore and the top of the annulus bore are usually capped by a Christmas tree cap which typically seals off the various bores in the Christmas tree.

Mature sub-sea oil wells producing at high water-cuts often lack the necessary pressure drive to flow at economic rates and are often hampered by the back-pressure exerted on them by the processing facilities. Several means of artificial lift are available to boost production rates, but they either involve a well intervention or modification to the sea bed facilities, both of which are expensive options and may be sub-economic for sub sea wells late in the life cycle with limited remaining reserves.

PCT/GB00/01785 (which is hereby incorporated by reference) describes a method of recovering production fluids from a well having a tree having a first flowpath and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath, and typically uses a tree cap to seal off the production and annulus bores, and to divert the fluids.

The present invention provides a flow diverter assembly for a tree, the flow diverter assembly having a flow diverter to divert fluids flowing through the production bore of the tree from a first portion of the production bore to the cap, and to divert the fluids back from the cap to a second portion of the production bore for recovery therefrom via an outlet, wherein the flow diverter is detachable from the cap to enable insertion of the flow diverter through the cap.

The tree is typically a subsea tree (such as a Christmas tree) on a subsea well.

The diverter assembly typically includes the cap. The diverter can be locked to the cap by a locking means.

Typically, the diverter assembly can be formed from high-grade steels or other metals, using e.g. resilient or inflatable sealing means as required.

The diverter may include outlets for diversion of the fluids to a pump or treatment assembly remote from the cap.

The flow diverter preferably comprises a conduit capable of insertion into the production bore, the assembly having sealing means capable of sealing the conduit against the wall of the production bore. The conduit may provide a flow diverter through its central bore which typically leads to a tree cap and the pump mentioned previously. The seal effected between the conduit and the production bore prevents fluid from the first portion of the production bore entering the annulus between the conduit and the production bore except as described hereinafter. After passing through a typical booster pump, squeeze or scale chemical treatment apparatus, the fluid is diverted into the second portion of the production bore and from there to the production bore outlet.

Optionally the fluid may be diverted through a crossover back to the production bore and then onto the production bore outlet.

The pump can be powered by high-pressure water or by electricity, which can be supplied direct from a fixed or floating offshore installation, or from a tethered buoy arrangement, or by high-pressure gas from a local source.

The cap preferably seals within Christmas tree bores above an upper master valve. Seals between the cap and bores of the tree are optionally O-ring, inflatable, or preferably metal-to-metal seals. The apparatus can be retrofitted very cost effectively with no disruption to existing pipework and minimal impact on control systems already in place. Preferably the cap includes equivalent hydraulic fluid conduits for control of tree valves, and which match and co-operate with the conduits or other control elements of the tree to which the cap is being fitted.

The typical design of the flow diverter within the cap can vary with the design of tree, the number, size, and configuration of the diverter channels being matched with the production and annulus bores, and others as the case may be. Preferably the diverters in the cap comprise a number of valves to control the inflow and outflow of fluids therefrom. This provides a way to isolate the pump from the production bore if needed, and also provides a bypass loop.

Certain embodiments of the apparatus can typically comprise a conduit that seals within the tree bore above the upper master valve and diverts flow to a remote device for pressure boosting or flow testing. Having flow tested or pressure boosted the produced fluids, the fluids are connected to the annular space between the flow diverter and the original tree bore or the tree crossover pipework/annulus bore, into the existing flowline via the existing wing valve. The concept allows the device to be installed/retro fitted very cost-effectively with no disruption to existing pipework and minimal impact on control systems.

Certain embodiments of the diverter allow insertion through the tree cap after the cap is attached to the tree, and may withdrawn through the cap without detaching the cap from the tree.

Typically the cap is deployed as part of the standard drilling stack. Typically the conduit is fitted to the cap after installation of the cap along with a lower riser package and can use the hydraulic functionality of the existing tree cap to enable additional valves to be controlled, and provides a means to isolate the pump from the production bore, if required. However, certain embodiments of the invention can be deployed without MODU, DSV, or RSV support, can simply be operated from a local tool placed on or near to the tree cap.

The invention also provides a method of installing a flow diverter on a tree, the method comprising attaching a cap to the tree, and installing the diverter through the cap after the cap has been attached to the tree.

The diverter can be carried by the cap (for example on the outboard end of the cap) while the inboard end of the cap is being attached to the tree, or can be conveyed from a remote position (e.g. the surface) after the cap has been attached to the tree.

The conduit is typically attached to the cap, held within the production bore of the tree and sealed therein thus enabling flow to be diverted through the bore of the insert to the cap and thereafter to the surface for testing or pumping then re-injected via the riser annulus or the external flowline through the annulus between the production bore and conduit and into the production pipeline or flowline. Alternatively the fluid may be re-injected into the tree via an annulus or other bore of the tree after treatment, and from there diverted via a crossover to the first flowpath and the outlet.

The flow diverter assembly can be used as part of the drilling riser package to enable flow to be directed through the surface test package, either choke manifold or multiphase meter, and then into the flowline via the tree.

The cap is typically installed on top of the tree and below the Lower Riser Package or the Subsea test tree, dependent on the tree configuration, or as extended tubing from the surface at the surface tree or on coiled tubing or wireline or seal directly against the bore of diverter unit.

The cap typically comprises a connector to interface with the tree, internal valving and flow paths.

The upper end of the conduit may be sealed against the LRP bore at the LRP XOV valve to provide the same function. The upper end of the conduit may be sealed against the surface tree bore to provide the same functionality.

In well test applications, the method enables the produced fluids to be well tested at surface and re-injected into the flowline thus potentially eliminating well flaring and enabling extended well testing.

Following well tests the cap and diverting means can be left in place and connected to a pumping package for pressure boosting if required.

With an MODU, installation of the diverter may be achieved without retrieving and re-running the drilling stack to seabed. With a DSV, the insert removes the need for storage, which brings realistic well testing objectives within the capabilities of a suitably equipped mono hull.

The assembly and method are typically suited for subsea production wells in normal mode or during well testing, but can also be used in subsea water injection wells, land based oil production injection wells, and geothermal wells.

The present invention also provides a method of recovering production fluids from a well having a tree, the tree having a first flowpath and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath, wherein the fluids are diverted from the wellhead to a remote location, and are returned to the wellhead from the remote location for diversion into the outlet of the first flowpath.

Preferably the first flowpath is a production bore, and the first portion of it is typically a lower part near to the wellhead. The second portion of the first flowpath is typically an upper portion of the bore adjacent a branch outlet, although the second portion can be in the branch or outlet of the first flowpath.

The diversion of fluids from the first flowpath allows the treatment of the fluids (e.g. with chemicals) or pressure boosting for more efficient recovery before re-entry into the first flowpath.

Optionally the second flowpath is an annulus bore of the tree, or an annulus between a conduit inserted into the first flowpath, and the bore of the first flowpath. Other types of bore may optionally be used for the second flowpath instead of an annulus bore.

Typically the flow diversion from the first flowpath to the second flowpath is achieved by a cap on the tree. Optionally, the cap contains a pump or treatment apparatus, but this can preferably be provided separately, or in another part of the apparatus, and in most embodiments, flow will be diverted via the cap to a remote pump etc and returned to the cap by way of tubing.

According to a further aspect of the present invention there is provided a method for recovering fluids from a well having a tree, the tree having a cap and a first flowpath and a second flowpath, the method comprising attaching the cap to the tree, inserting a fluid diverter to divert fluids from a bore of the tree to a second flowpath, diverting fluids from the second flowpath back to a second portion of the bore, and thereafter recovering fluids from the outlet of the bore wherein the first or second flowpath is attached to or detached from the cap without detaching the cap from the tree.

Typically the method includes the step of withdrawing a plug from the bore (e.g. the production bore of the tree) after the cap has bean attached, and thereafter inserting the fluid diverter into the production bore of the tree, typically through the cap.

Preferably the diverter comprises a tubular or other conduit inserted into the production bore. The second flowpath can comprise the bore of the tubular or other conduit. Alternatively the second flowpath may comprise the annulus between the tubular or conduit and a bore (e.g. the production bore) of the tree.

Typically the cap is provided to hold the tubular or other conduit in place. Typically the cap has a through-bore. Optionally the through-bore of the cap has wireline grooves that can engage the conduit, in order to hold it in place in the first flowpath. Alternatively the cap and conduit may engage by other means e.g. resilient teeth, thread etc. Typically the cap is attached to the top of the tree and is inserted as part of the drilling stack (which connects the tree to the surface vessel). The first flowpath is then free from obstructions, and plugs (which are commonly inserted downhole above the production bore outlet before production is commenced) may then be removed. The bore is then typically filled with dense fluid and optionally pressurised in order to prevent well blow out. The conduit is then typically lowered on a line (e.g. wireline) down the drilling stack into the cap, which engages the conduit by the wireline grooves or threads, or by other engaging means as provided. The conduit is then held within the first flowpath.

The conduit typically has a second sealing means, which seals the conduit to the production bore and diverts fluids from a first portion of the production bore into the bore of the second flowpath, normally the annulus.

Embodiments of the invention allow for production fluid or water injection boosting, subsea metering, chemical injection, and extended well test re-injection. For example, in certain embodiments used in a water injection tree, the flow of fluids through the production conduits can be reversed, with water being injected back through the production wing, through the insert and the cap, and into the production bore to pressurise the reservoir.

Embodiments of the invention will now be described by way of example only with reference to the accompanying drawings in which:

FIG. 1 is a side sectional view of a typical production tree;

FIG. 2*a* is a side view of the FIG. 1 tree with a cap in place;

FIG. 2*b* is a diagram of the valve interconnections of the FIG. 2*a* embodiment during drilling mode;

FIG. 3*a* is a view of the FIG. 1 tree with the cap and a conduit in place;

FIG. 3*b* is a diagram of the valve interconnections of the FIG. 3*a* embodiment during drilling mode;

FIG. 3*c* is a diagram of the valve interconnections of the FIG. 3 embodiment in flow injection mode;

FIG. 4 is a side sectional view of a further embodiment with the cap and a conduit in place;

FIG. 5*a* is a side sectional view of a further embodiment with the cap and a straddle in place; and, FIG. 5*b* is a diagram of the valve interconnections of the FIG. 5*a* embodiment during drilling mode;

Figure 1:
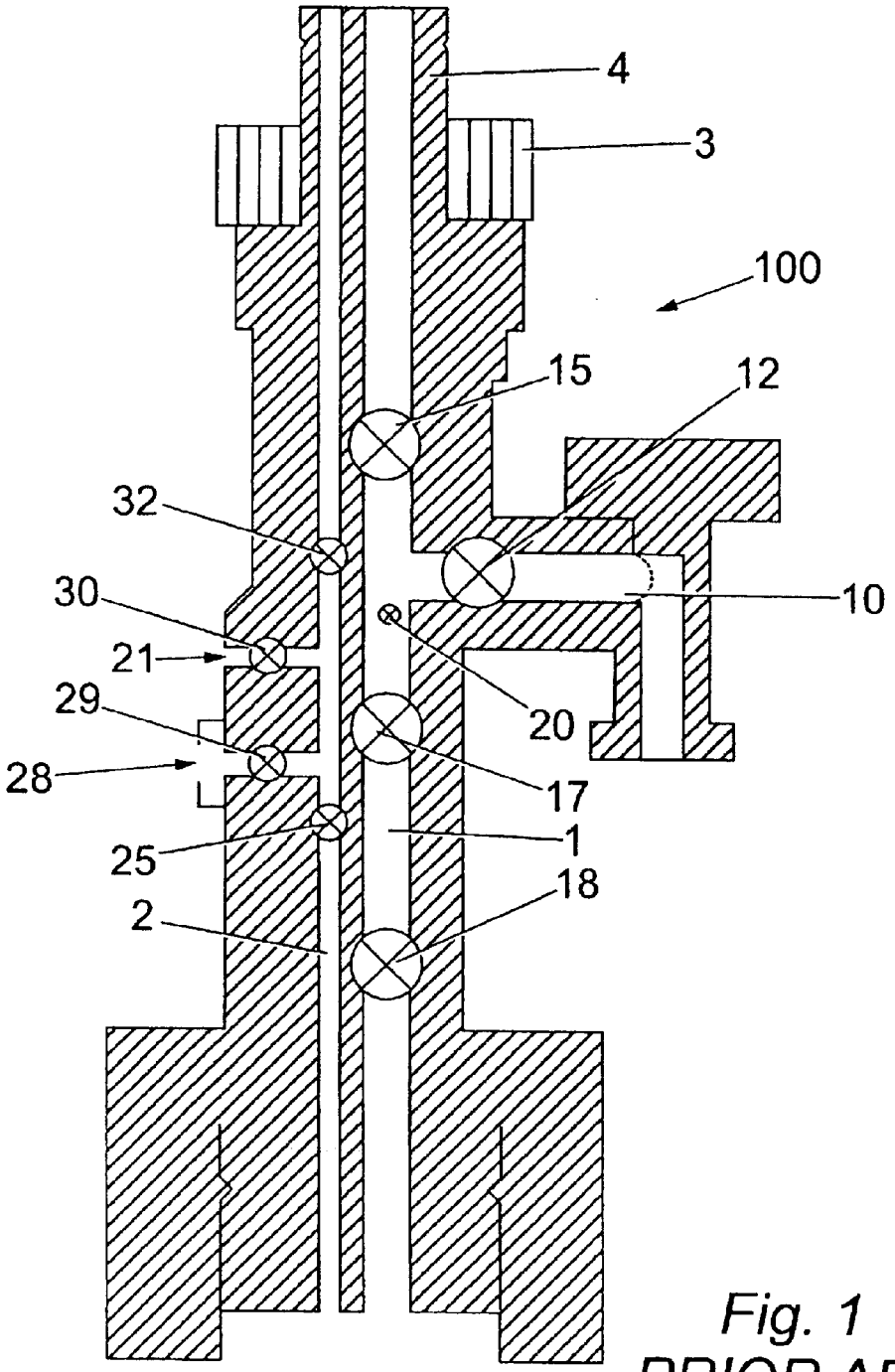
Fig. 1 PRIOR ART

Referring now to the drawings, a typical production tree 100 on an offshore oil or gas wellhead comprises a production bore 1 leading from production tubing (not shown) and carrying production fluids from a perforated region of the production casing in a reservoir (not shown). An annulus bore 2 leads to the annulus between the casing and the production tubing and a Christmas tree seal or cap 4 which seals off the production and annulus bores 1, 2, and provides a number of hydraulic control channels 3 by which a remote platform or intervention vessel can communicate with and operate the valves in the Christmas tree. The cap 4 is removable from the Christmas tree in order to expose the production and annulus bores in the event that intervention is required and tools need to be inserted into the production or annulus bores 1, 2.

The flow of fluids through the production and annulus bores is governed by various valves shown in the typical tree of FIG. 1. The production bore 1 has a branch 10 that is closed by a production wing valve (PWV) 12. A production swab valve (PSV) 15 closes the production bore 1 above the branch 10 and PWV 12. Two lower production master valves UPMV 17 and LPMV 18 (LMPV 18 is optional) close the production bore 1 below the branch 10 and PWV 12. Between UPMV 17 and PSV 15, a crossover port (XOV) 20 is provided in the production bore 1 which connects to a crossover port (XOV) 21 in annulus bore 2.

The annulus bore 2 is closed by an annulus master valve (AMV) 25 below an annulus outlet 28 controlled by an annulus wing valve. (AWV) 29 below crossover port 21. The crossover port 21 is closed by crossover valve 30. An annulus swab valve 32 located above the crossover port 21 closes the upper end of the annulus bore 2.

All valves in the tree are typically hydraulically controlled (with the exception of LPMV 18 which may be mechanically controlled) by means of hydraulic control channels 3 passing through the seal 4 and the body of the tool or via hoses as required, in response to signals generated from the surface or from an intervention vessel.

When production fluids are to be recovered from the production bore 1, LPMV 18 and UPMV 17 are opened, PSV 15 is closed, and PWV 12 is opened to open the branch 10 which leads to the pipeline (not shown). PSV 15 and ASV 32 are only opened if intervention is required.

Figure 2A:
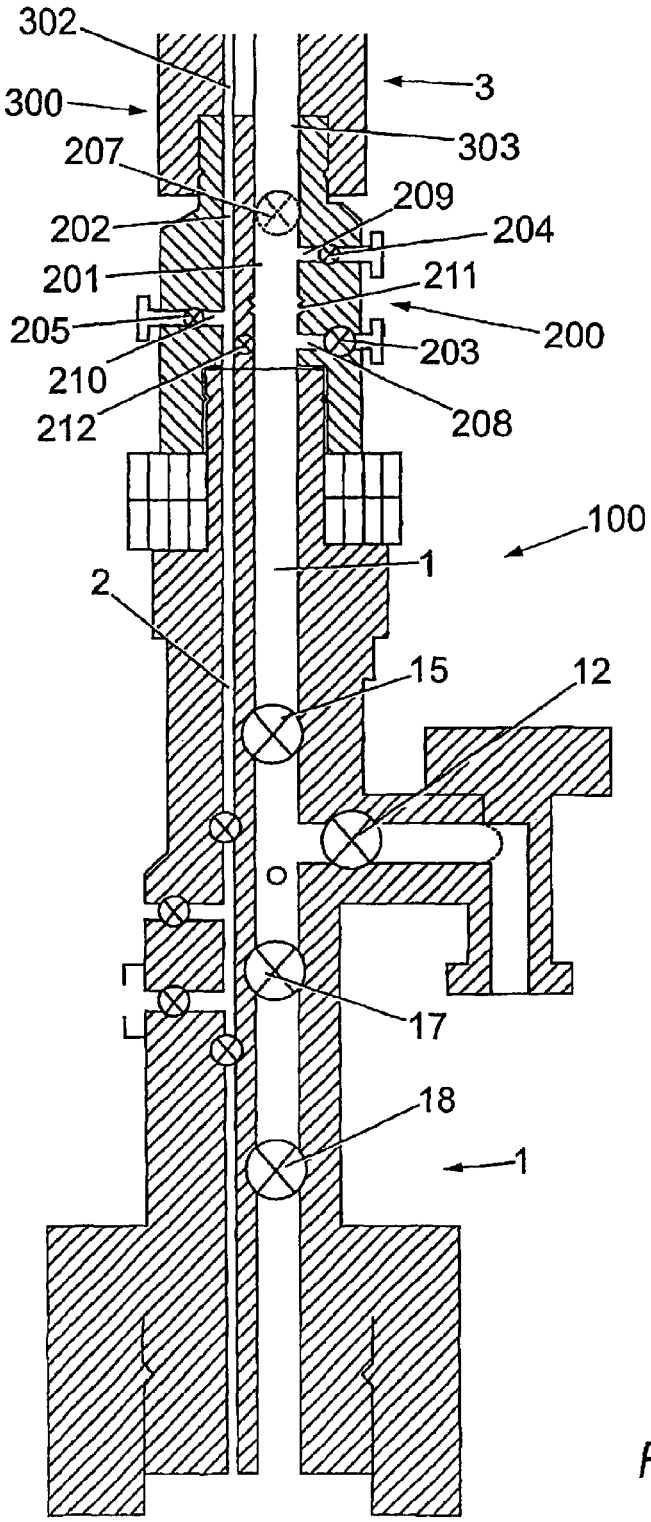
Figure 2B:
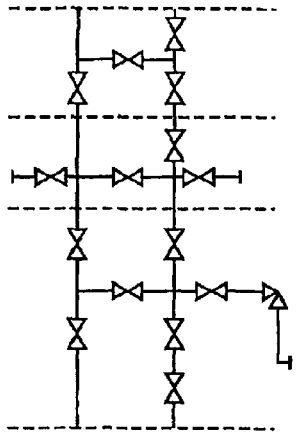

Referring now to FIG. 2, a cap 200 is mounted onto the typical production tree 100 along with the lower riser package and emergency disconnect package (LRP/EDP) 300. The cap 200 and LRP/EDP 300 connect to the tree 100 by means of a box and pin connection, as standard in the industry. The production bore 1 and annulus bore 2 of the tree are aligned with the corresponding bores of the cap 200 and LRP/EDP 300.

Branches 208, 209 extend from a production bore 201 of the cap 200, each provided with a wing valve 203, 204 respectively. A similar branch 210 is connected to an annulus bore 202 of the cap 200 having a valve 205. A valve 207 is provided in the production bore 201 above the branches 208, 209. A further valve 212 connects the production 201 and annulus 202 bores of the cap 200. Wireline grooves 211 are provided on the inside of the production bore 201 of the cap 200 between the ports 208, 209.

Typically a metal seal (not shown) is provided in the production bore 1 below the LPMV valve 18 to prevent the escape of fluids when the system is not in use, for example, due to extreme weather conditions or immediately after construction of the tree system 100.

A separate detachable insert or conduit 42 is inserted into the production bore 1 (FIG. 3) through the cap 200 and attached at its upper end to the cap 200 by means of the wireline grooves 211 on the cap 200. The insert 42 is attached to the inner surface of the production bore 1 at its lower end by inflatable or resilient seals 43 which can seal the outside of the conduit 42 against the inside walls of the production bore 1 to divert production fluids flowing up the production bore 1 in the direction of arrow 101 into the hollow bore of the conduit 42,and from there into the cap 200. The conduit 42 and the cap 200 together form a flow diverter.

Tubing (not shown) is attached to output port 209 of the cap 200 to divert the fluids to a remote location for treatment such as quality analysis, pressure boosting via a pump etc and thereafter returned via tubing attached to the input port 208. The treatment apparatus is normally provided on a fixed or floating offshore installation.

To assemble the system, the cap 200 and LRP/EDP 300 are lowered into place from e.g. the rig or service vessel and secured onto the top of the tree 100, as shown in FIG. 2. LPMV 18, UPMV 17, PSV 15 and valve 207 are opened and PWV 12 is closed. The metal seal (not shown) below the LPMV 18 is removed to the surface from the production bore 1 via the cap 200 and LRP/EDP 300. The bores 1, 201, 301 are then optionally filled with dense liquid, pressurised at the surface to resist expulsion of production fluid, and the conduit 42 is lowered from the surface to the cap 200 on wireline.

Figure 3A:
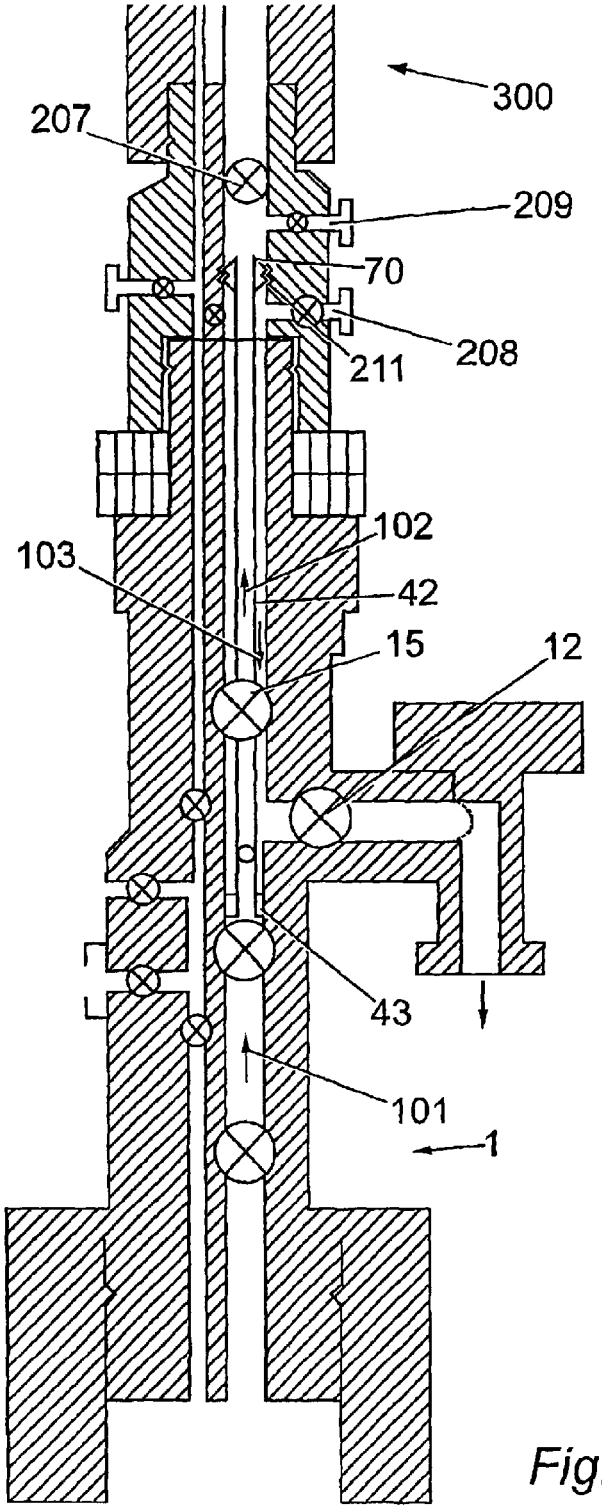
Figure 3B:
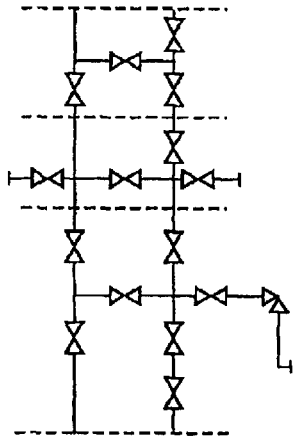
Figure 3C:
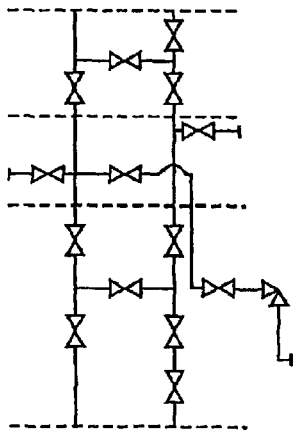

The conduit 42 is inserted though the cap 200 and secured into the production bore 201 of the cap 200 by any suitable means e.g. by wireline grooves, threads or resilient teeth, and is also secured to the production bore 1 of the tree 100 below PSV 15 and PWV 12 by inflatable or resilient seals 43 which can seal the outside of the conduit 42 against the inside walls of the production bore 1 to divert production fluids flowing up the production bore in the direction of arrow 101 into the hollow bore of the conduit 42 and from there into the cap 200 as shown in FIG. 3.

An advantage of the detachable conduit 42 is that the cap 200 may be installed with the lower riser package 300 (LRP) before removal of the full bore plugs etc. After removing these plugs through the cap by conventional means the conduit 42 may be attached as described herein. Thus the conduit 42 and cap 200 may be installed in a wide variety of trees, regardless of whether there are plugs within the bore or not. Typically a pressurised installation system can be used in such cases. In trees with no plugs, e.g. horizontal trees, the cap is typically installed as part of the LRP and the conduit may be inserted when required. This obviates the need for retraction of the LRP etc to attach the conduit, which would result in a pause in fluid recovery and an associated loss in revenue. With a pressurised installation tool the insert 42 can be installed and removed as necessary.

In use, the production fluids are recovered from the production bore 1 and directed into the bore of the conduit 42 as explained above. The fluids flow into the cap 200 that optionally diverts them to a remote surface test and clean up package to flare or storage via the tubing (not shown). The fluids (which may also be flow tested during well testing at the surface) are then re-injected into the tree via the branch 208, continue through the annulus between the conduit 42 and the production bore 1 in the direction of arrow 103 and thereafter through the branch 10 to the pipeline (not shown).

Embodiments of the present invention therefore may remove the need for onboard storage of hydrocarbons, potentially eliminates flaring in wells when the flowline is attached and can enable well testing from a single hull DSV.

Figure 4:
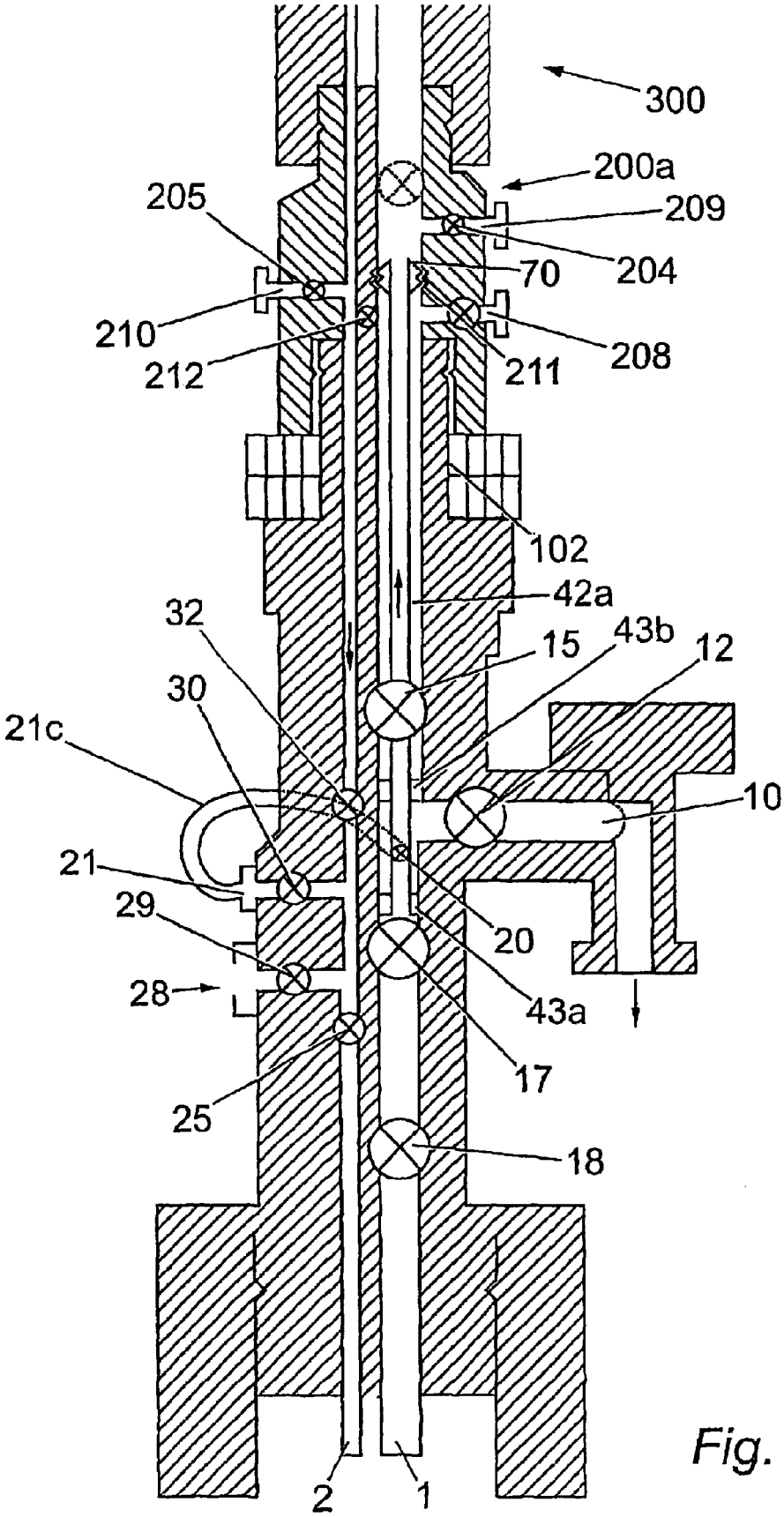

An alternative embodiment is shown in FIG. 4. The cap 200*a* has a large diameter conduit 42*a* extending through the open PSV 15 and terminating in the production bore 1 having seal stack 43*a* below the branch 10, and a further seal stack 43*b* sealing the bore of the conduit 42*a* to the inside of the production bore 1 above the branch 10, leaving an annulus between the conduit 42*a* and bore 1. Seals 43*a* and 43*b* are optionally disposed on an area of the conduit 42*a* with reduced diameter in the region of the branch 10. Seals 43*a* and 43*b* are also disposed on either side of the crossover port 20 communicating via channel 21*c* to the crossover port 21 of the annulus bore 2. In the cap 200*a*, the conduit 42*a* is closed by cap service valve (CSV) 204 which is normally open to allow flow of production fluids from the production bore 1 via the central bore of the conduit 42*a* through the outlet 209 to the remote pump or chemical treatment apparatus. The treated or pressurised production fluid is returned from the remote pump or treatment apparatus to the inlet of branch 210 which connects to the annulus bore 202 in the cap 200 and is controlled by cap flowline valve (CFV) 205. Annulus swab valve 32 is normally held open, annulus master valve 25 and annulus wing valve 29 are normally closed, and crossover valve 30 is normally open to allow production fluids to pass through the annulus bore 2, then through the crossover channel 21*c* and crossover port 20 between the seals 43*a* and 43*b* into the annulus between the insert 42*a* and the production bore 1, and thereafter through the open PWV 12 into the bore of the outlet 10 for recovery to the pipeline.

A crossover valve 212 is provided between the production bore 201 and the annular bore 202 in order to bypass the pump or treatment apparatus if desired. Normally the crossover valve 212 is maintained closed.

This embodiment maintains a fairly wide bore for more efficient recovery of fluids at relatively high pressure, thereby reducing pressure drops across the apparatus.

This embodiment therefore provides a diverter assembly for use with a wellhead tree comprising a thin walled conduit with two seal stack elements, connected to a tree cap, which straddles the crossover valve outlet and flowline outlet (which are approximately in the same horizontal plane), diverting flow through the centre of the conduit and the top of the tree cap to remote pressure boosting or chemical treatment apparatus etc, with the return flow routed via the tree cap and annulus bore (or annulus flow path in concentric trees) and the crossover loop and crossover outlet, to the annular space between the straddle and the existing tree bore through the wing valve to the flowline.

Like the previous embodiment, the insert 42*a* can be inserted separately from the cap after the cap has been attached, and can be secured by wireline grooves etc and/or inflatable seals to the production bore and/or the cap. However, this embodiment can also be deployed from a local tool on the tree without requiring the support of a MODU, DSV, or RSV. The tool can carry the insert 42*a* and can be deployed on top of the cap to install the insert through the cap if desired.

Figure 5A:
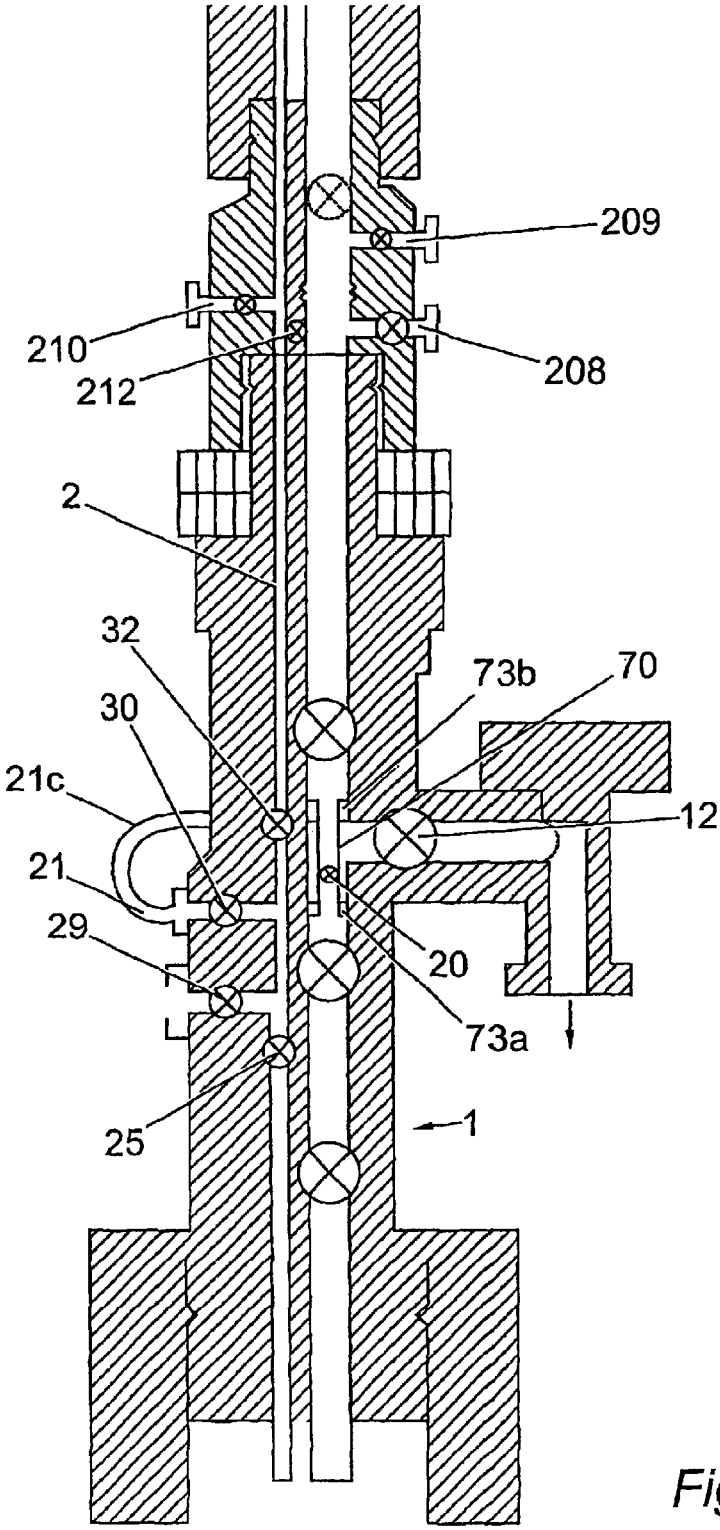
Figure 5B:
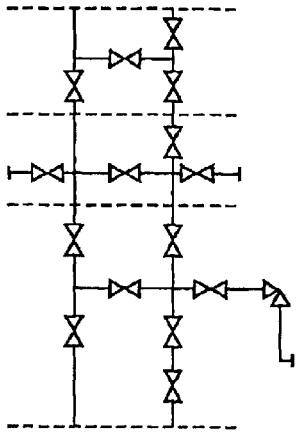

A further, simpler embodiment is shown in FIG. 5 where the conduit 42*a* is replaced by a production bore straddle 70 inserted after the attachment of the cap in a similar manner to the insert 42 as previously described, and having seals 73*a* and 73*b* disposed on either side of a crossover port 20 but which functions in a similar way as the FIG. 4 embodiment.

In use, the production fluids flow up the production bore 1 through the bore of the straddle 70 and into the cap 200 where they are optionally diverted via outlets 208 or 209 to remote treatment or testing apparatus as described for previous embodiments. After suitable treatment the fluids are re-injected into the annulus bore 2 of the tree 100 via the inlet 210. Annulus swab valve 32 is normally held open, with annulus master valve 25 and annulus wing valve 29 normally closed, and crossover valve 30 normally open to allow production fluids to pass through crossover channel 21*c* and crossover port 20 into the annulus between the straddle 70 and the production bore 1 between the seals 43*a* and 43*b*, and thereafter through the open PWV 12 into the production outlet 10 for recovery to the pipeline.

This embodiment therefore provides a fluid diverter for use with a wellhead tree which is not connected to the tree cap by a thin walled conduit, but is anchored in the tree bore, and which allows full bore flow above the "straddle" portion, but routes flow through the crossover and will allow a swab valve (PSV) 15 to function normally. Again the straddle can be fitted separately through the cap by means of wireline etc.

The cap can be retrofitted to an existing tree cap to use the hydraulic functionality of the existing tree-cap to enable additional valves to be controlled, and provides a means to isolate the pump from the production bore, if required. Certain embodiments of the invention allow the device to be installed/retro-fitted very cost effectively, with no disruption to existing pipework and minimal impact on control systems.

The cap can be used as part of the drilling riser package to enable flow to be directed through the surface test package, either choke manifold or multiphase meter, and then into the flowline via the tree. The cap is normally installed on top of the tree and below the Lower Riser Package or the subsea test tree, dependent on the tree configuration or as extended tubing from the surface at the surface tree or on coiled tubing or wireline or seal directly against the bore of diverter unit.

Figure 6:
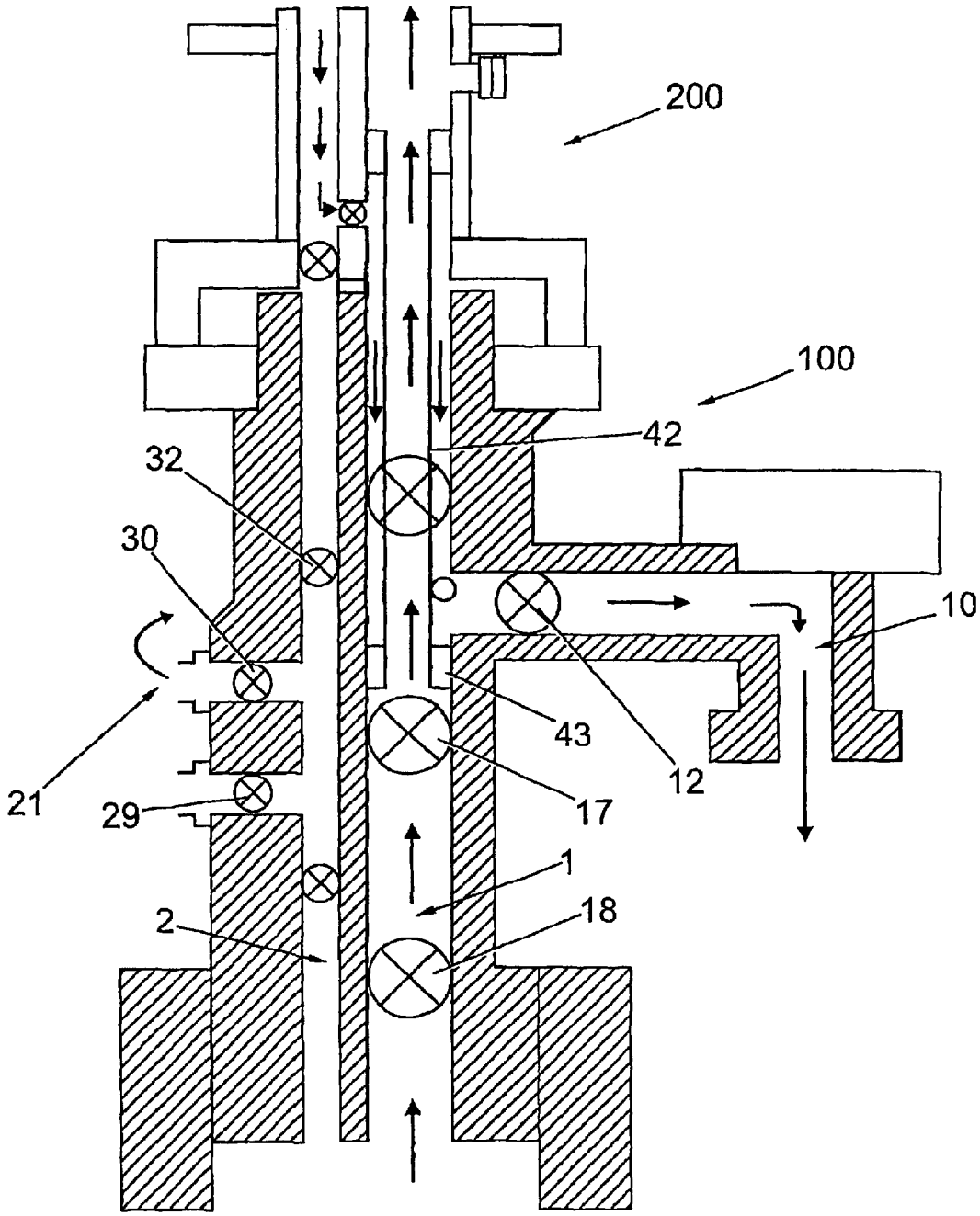
FIG. 6 is a side sectional view of a further tree with the cap and conduit in place.

A modified embodiment is shown in FIG. 6, in which an insert 42 inserted through the cap 200 into the production bore 1 of a production tree 100 similar to that shown in earlier figures, but in which the insert 42 diverts the production fluids out through the cap 200 into a remote booster pump or chemical treatment device at the wellhead (not shown), and back into the top of the annulus bore 2 of the tree. The annulus swab valve 32 is closed off denying passage of the production fluids through the crossover as shown in the FIGS. 4 and 5 embodiments, but instead the cap crossover valve 212 is open diverting the treated fluids from the wellhead back into the annulus between the production bore 1 and the insert 42, and thereafter out through the outlet of the production bore and production wing valve 12.

This embodiment illustrates that different routes can be selected through the cap with only surface control by opening and closing valves in the tree or cap using existing hydraulic connections.

Figure 7:
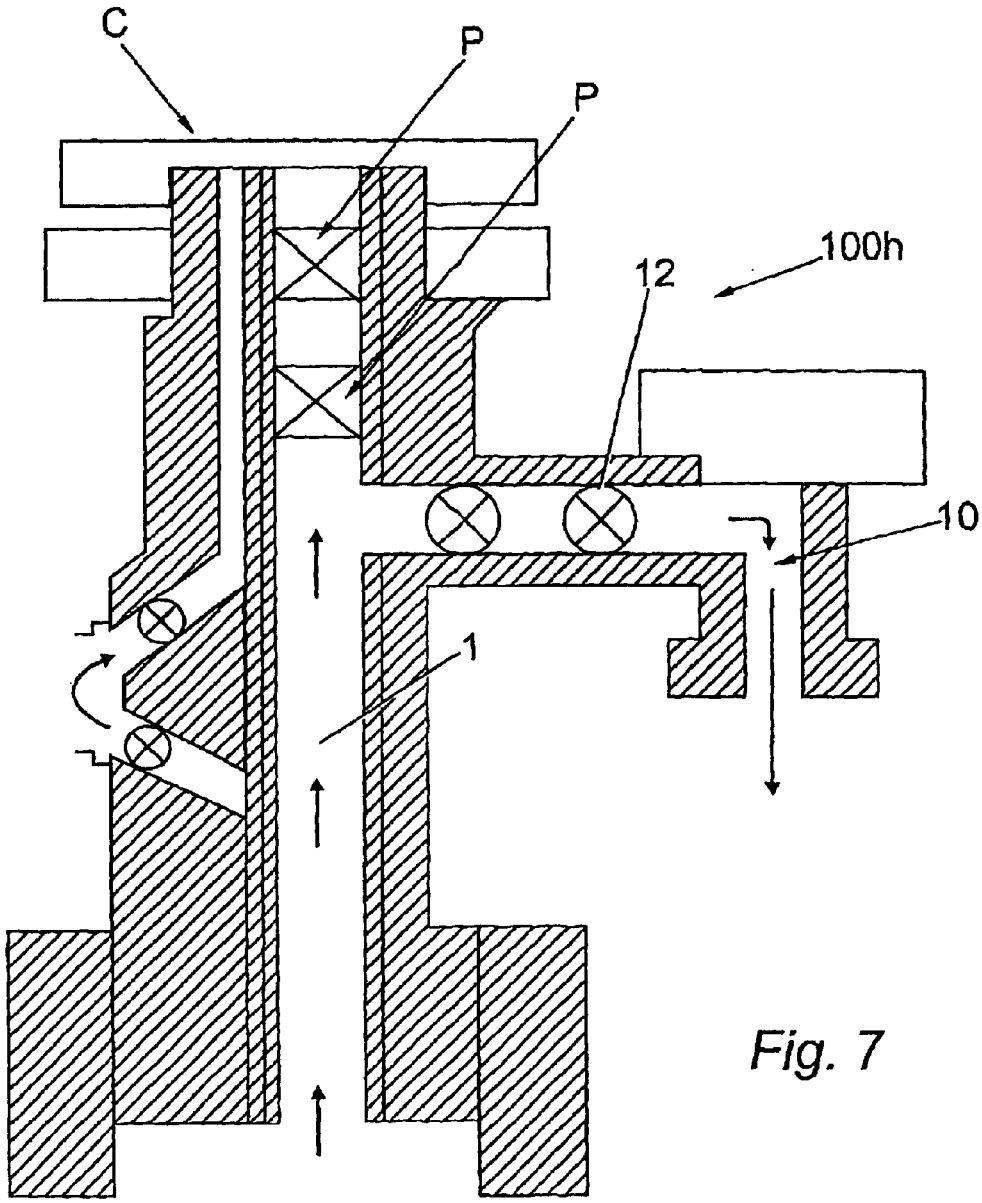
FIG. 7 is a side sectional view of a conventional horizontal tree.
Figure 8:
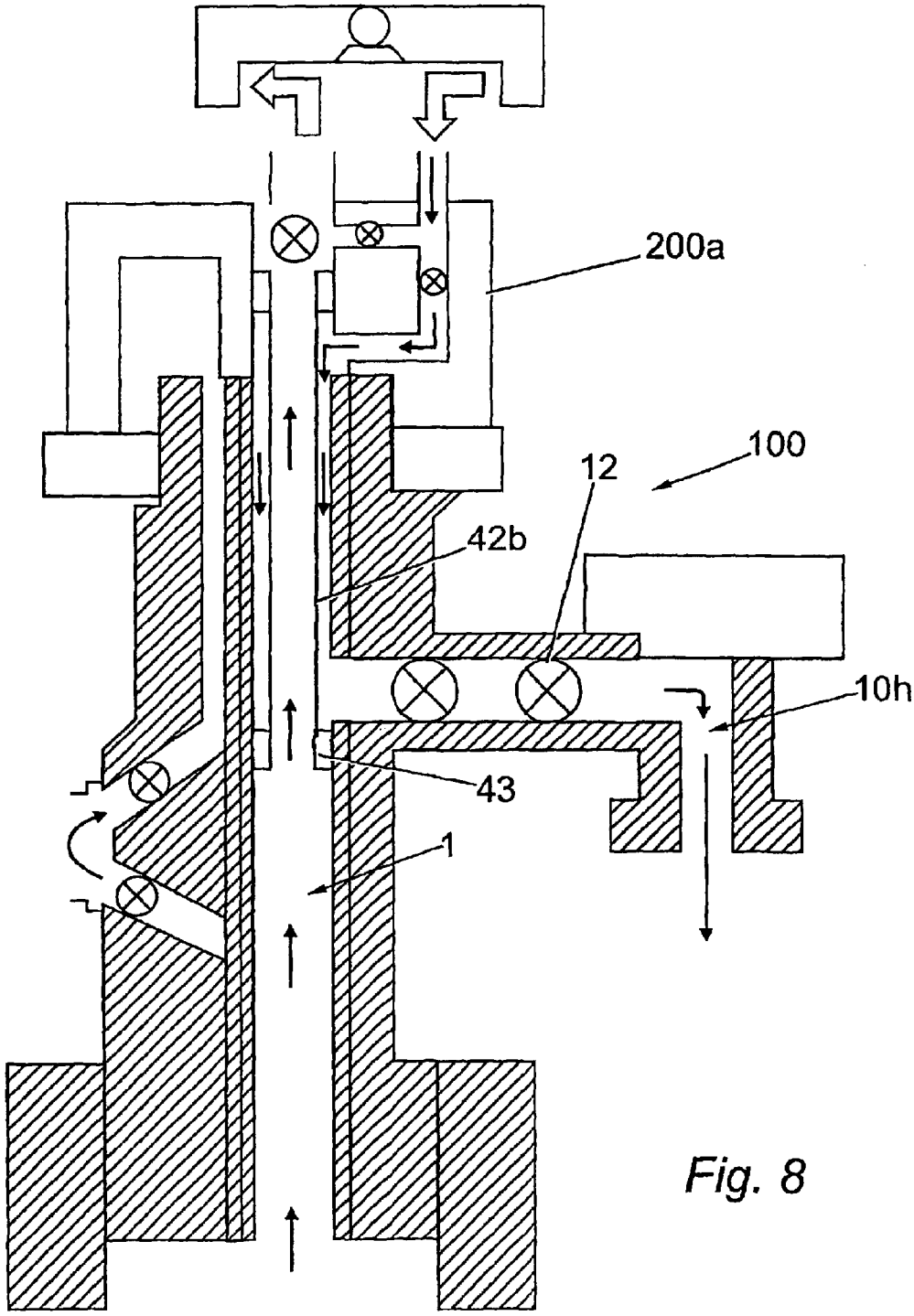
FIG. 8 is a side sectional view of the FIG. 7 embodiment with a further embodiment of a cap installed.

FIG. 7 shows a schematic view of a conventional horizontal tree 100*h* with plugs P in the production bore 1, a conventional tree cap C, and having no valves above the production wing. FIG. 8 shows an embodiment of the invention adapted for use with horizontal trees, having an insert 42*b* selectively attached to a modified cap 200*a* as previously described, and to the production bore 1 by seals 43 below the production wing outlet 10*h*. The cap 200*a* can be installed as normal and the insert 42*b* can be inserted from a pressurised tool or from surface if the bore is pressurized or filled with dense fluid to equalise the wellbore pressure during insertion. The production bore plugs P can be withdrawn into the insertion tool before the inserted is introduced into the production bore, and sealed therein. After insertion of the insert 42*b* the production fluids are diverted into the cap 200*a* to a wellhead booster or testing/treatment apparatus (not shown) and back to the cap 200*a*, into the annulus between the production bore 1 and the insert 42*b*, and thence to the production wing outlet 10*h*.

The installation sequence of the FIG. 8 embodiment is typically as follows:

The bores are first integrity tested from surface, ensuring that there are no leaks in the system. The cap C is then removed by a tree cap removal tool lowered from surface, after the production and annulus bores have been rigorously tested. After removal of the conventional cap, the cap 22*a* according to the invention is lowered from surface, attached to the tree block, attached to the hydraulic control lines of the previous tree cap and tested. The cap 200*a* is maintained under pressurised conditions and has a plug removal tool that removes the plugs P from the production bore 1 while maintaining wellbore pressure in the tool. After removal of the plugs P the insert 42*b*, which is typically carried on the outboard end of the cap 200*a* or by a separate installation tool landed on the cap 200*a*, is then stroked into the production bore 1 and sealed to the cap 200*a* and the production bore below the production wing outlet 10*h*. The insert swab valve is then opened and the system again tested for pressure integrity. A pump can then be lowered to the wellhead and attached locally to the top of the cap 200*a* or can be run from surface as required. Thereafter, the production fluids are then diverted from the production bore through the bore of the insert 42*b*, into the cap 200*a*, through the pump and back into the annulus between the insert 42 and the production bore 1 as previously described, before being recovered as normal from the outlet 10*h* of the production wing.

The above embodiment can be deployed from a local tool landed on the tree and therefore can dispense with the requirement for support from a MODU, DSV or RSV, with associated cost savings. The FIG. 8 embodiment can be used for horizontal and vertical trees, and is typically deployed with a pressurised tool to remove the plugs and install the insert.

The pump can be substituted for a chemical injection apparatus, and the insert can be attached entirely to the production bore rather than to the cap 200*a*.

Certain embodiments of the invention may be most readily utilised on remote subsea production wells in normal mode or during well testing, although other embodiments may be used on sub sea water injection wells, land based oil production and injection wells and possibly geothermal wells. A pump may be connected to the head and powered by high-pressure water or electricity, which could be supplied directly from a fixed or floating offshore installation, or from a tethered buoy arrangement or by high-pressure gas from a local source for example.

Modifications and improvements may be made without departing from the scope of the invention.

What is claimed is:

1. A flow diverter assembly for a tree, the flow diverter assembly having a flow diverter to divert fluids flowing through a production bore of the tree from a first portion of the production bore to a cap on the tree, and to divert fluids returned from the cap to a second portion of the production bore for recovery therefrom via an outlet, wherein the flow diverter is detachable from the cap to enable insertion of the flow diverter through the cap.

2. An assembly as claimed in claim 1, wherein the tree is a subsea tree.

3. An assembly as claimed in claim 1, wherein the flow diverter comprises a conduit inserted into the production bore.

4. An assembly as claimed in claim 3, having a sealing device adapted to seal the conduit against the wall of the production bore.

5. An assembly as claimed in claim 3, wherein the conduit provides a first flowpath through a bore thereof, and a second flowpath in the annulus between the conduit and the production bore.

6. An assembly as claimed in claim 1, wherein the flow diverter is adapted to be withdrawn through the cap without detaching the cap from the tree.

7. A method of installing a flow diverter on a tree, the method comprising attaching a cap to the tree, and installing the diverter through the cap after the cap has been attached to the tree, wherein the diverter is adapted to divert fluids flowing through a production bore of the tree from a first portion of the production bore to a cap on the tree, and to divert fluids returned from the cap to a second portion of the production bore.

8. A method as claimed in claim 7, wherein the diverter is carried by the cap.

9. A method as claimed in claim 7, wherein the flow diverter is installed from a local installation device.

10. A method of recovering production fluids from a well having a tree, the tree having a first flowpath and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath, wherein the fluids are diverted from the wellhead to a remote location, and are returned to the wellhead from the remote location for diversion into the outlet of the first flowpath.

11. A method as claimed in claim 10, wherein the first flowpath is a production bore.

12. A method as claimed in claim 10, wherein the second flowpath is an annulus bore of the tree.

13. A method as claimed in claim 10, wherein the flow diversion from the first flowpath to the second flowpath is achieved by a cap on the tree.

14. A method for recovering fluids from a well having a tree, the tree having a first flowpath and a second flowpath and being adapted to engage a cap, the method comprising attaching the cap to the tree, inserting a fluid diverter to divert fluids from a bore of the tree to a second flowpath, diverting fluids from the second flowpath back to a second portion of the bore, and thereafter recovering fluids from the outlet of the bore wherein the fluid diverter is inserted without detaching the cap from the tree.

15. A method as claimed in claim 14, including the steps of withdrawing a plug from the bore of the tree after the cap has been attached, and thereafter inserting the fluid diverter into the bore of the tree.

16. A method as claimed in claim 14, wherein the diverter comprises a conduit inserted into the bore of the tree.

17. A method as claimed in claim 14, including the step of removing a plug from the bore before the flow diverter is inserted.

18. A method as claimed in claim 14, wherein the flow diverter is inserted by wireline.

19. A method as claimed in claim 14, wherein the flow diverter is inserted by a local installation device.

20. A method as claimed in claim 10, wherein the second flowpath is an annulus between a conduit inserted into the first flowpath and the bore of the first flowpath.

21. A method as claimed in claim 14, further including the step of subsequently removing the fluid diverter without detaching the cap from the tree.

* * * * *